US006733615B2

(12) United States Patent
Boyd et al.

(10) Patent No.: US 6,733,615 B2
(45) Date of Patent: May 11, 2004

(54) METHOD AND APPARATUS FOR FIXED ABRASIVE SUBSTRATE PREPARATION AND USE IN A CLUSTER CMP TOOL

(75) Inventors: John M. Boyd, Atascadero, CA (US); Michael S. Lacy, Astascadero, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/254,810

(22) Filed: Sep. 25, 2002

(65) Prior Publication Data

US 2003/0032287 A1 Feb. 13, 2003

Related U.S. Application Data

(63) Continuation of application No. 09/609,590, filed on Jun. 30, 2000, now Pat. No. 6,495,464.

(51) Int. Cl.[7] ..... H01L 21/306

(52) U.S. Cl. ..... 156/345.11; 156/345.12; 156/345.14; 156/345.18; 438/692

(58) Field of Search ..... 156/345.11, 345.12, 156/345.14, 345.18; 438/692, 693, 699

(56) References Cited

U.S. PATENT DOCUMENTS

| | | | |
|---|---|---|---|
| 3,753,269 | A | 8/1973 | Budman |
| 4,318,250 | A | 3/1982 | Klievoneit et al. |
| 4,510,113 | A | 4/1985 | Takano et al. |

(List continued on next page.)

FOREIGN PATENT DOCUMENTS

| | | |
|---|---|---|
| EP | 0 738 561 | 10/1996 |
| EP | 0 824 995 | 2/1998 |
| EP | 0 893 203 A | 1/1999 |
| JP | 8-187798 | 11/1996 |
| WO | WO 98/35785 | 8/1998 |
| WO | WO 98/36442 | 8/1998 |
| WO | WO 98/45090 | 10/1998 |
| WO | WO 99 06182 | 2/1999 |
| WO | WO 99/22908 | 5/1999 |

OTHER PUBLICATIONS

U.S. patent application Ser. No. 09/540,385 Method and Apparatus for Chemically–Mechanically Polishing Semiconductor Wafers—Inventors: Travis et al., Filing Date: Mar. 31, 2000 Attorney Docket No. 7103–123.

U.S. patent application Ser. No. 09/540,810 Fixed Abrasive Linear Polishing Belt and System—Inventors: Zhao et al. Filing Date: Mar. 31, 2000 Attorney Docket No. 7103–135.

U.S. patent application Ser. No. 09/541,144 Method and Apparatus for Chemical Mechanical Planarization and Polishing of Semiconductor Wafers Using a Continuous Polishing Member Feed—Inventors: Moork.

U.S. patent application Ser. No. 09/386,741 Unsupported Chemical Mechanical Polishing Belt—Inventors: Xu et al. Filing Date: Aug. 31, 1999 Attorney Docket No. 7103/83.

Inaba, S., Katsuyama, T., Tanaka, M., "Study of CMP Polishing pad Control Method", Feb. 19–20, 1998 CMP MIC Conference, 1998 IMIC–300P/98/0444.

*Primary Examiner*—Robert Kunemund
*Assistant Examiner*—Binh X. Tran
(74) *Attorney, Agent, or Firm*—Brinks Hofer Gilson & Lione

(57) ABSTRACT

An apparatus enabling preparation and use of a fixed abrasive polishing member is described. The apparatus includes a patterned three-dimensional substrate, an abrasive coating a surface of the patterned substrate and a vacuum deposition chamber in which the abrasive is applied to the surface of the substrate. In addition, rather than a fixed abrasive, non-abrasive material may be applied to the surface of the patterned substrate, in which case, a conventional slurry may be used in planarization of an applied semiconductor wafer.

31 Claims, 3 Drawing Sheets

U.S. PATENT DOCUMENTS 4,576,612 A 3/1986 Shukla et al.
4,672,985 A 6/1987 Mohr
4,720,939 A 1/1988 Simpson et al.
4,728,552 A 3/1988 Jensen, Jr.
4,753,838 A 6/1988 Kimura et al.
4,841,680 A 6/1989 Hoffstein et al.
4,927,432 A 5/1990 Budinger et al.
4,934,102 A 6/1990 Leach et al.
4,954,141 A 9/1990 Takiyama et al.
4,962,562 A 10/1990 Englund et al.
5,020,283 A 6/1991 Tuttle
5,081,051 A 1/1992 Mattingly et al.
5,104,421 A 4/1992 Takizawa et al.
5,177,908 A 1/1993 Tuttle
5,197,999 A 3/1993 Thomas
5,212,910 A 5/1993 Breivogel et al.
5,234,867 A 8/1993 Schultz et al.
5,257,478 A 11/1993 Hyde et al.
5,287,663 A 2/1994 Pierce et al.
5,329,734 A 7/1994 Yu
5,335,453 A 8/1994 Baldy et al.
5,433,651 A 7/1995 Lustig et al.
5,484,323 A 1/1996 Smith
5,487,697 A 1/1996 Jensen
5,489,233 A 2/1996 Cook et al.
5,531,635 A 7/1996 Mogi et al.
5,534,106 A 7/1996 Cote et al.
5,536,202 A 7/1996 Appel et al.
5,547,417 A 8/1996 Breivogel et al.
5,558,568 A 9/1996 Talieh et al.
5,575,707 A 11/1996 Talieh et al.
5,578,362 A 11/1996 Reinhardt et al.
5,593,344 A 1/1997 Weldon et al.
5,605,760 A 2/1997 Roberts
5,611,943 A 3/1997 Cadien et al.
5,622,526 A 4/1997 Phillips
5,643,044 A 7/1997 Lund
5,655,951 A 8/1997 Meikle et al.
5,692,947 A 12/1997 Talieh et al.
5,692,950 A 12/1997 Rutherford et al.
5,725,417 A 3/1998 Robinson
5,759,918 A 6/1998 Hoshizaki et al.
5,762,536 A 6/1998 Pant et al.
5,779,526 A 7/1998 Gill
5,810,964 A 9/1998 Shiraishi
5,871,390 A 2/1999 Pant et al.
5,897,426 A 4/1999 Somekh
5,899,798 A 5/1999 Trojan et al.
5,908,530 A 6/1999 Hoshizaki et al.
5,958,794 A * 9/1999 Bruxvoort et al. ..... 438/692
6,093,651 A * 7/2000 Andideh et al. ..... 438/692
6,206,759 B1 * 3/2001 Agarwal et al. ..... 451/41

* cited by examiner

METHOD AND APPARATUS FOR FIXED ABRASIVE SUBSTRATE PREPARATION AND USE IN A CLUSTER CMP TOOL

CROSS-REFERENCE TO RELATED APPLICATIONS

This application is a continuation of presently U.S. application Ser. No. 09/609,590 filed Jun. 30, 2000, now U.S. Pat. No. 6,495,464 entitled "Method And Apparatus For Fixed Abrasive Substrate Preparation And Use In A Cluster CMP Tool," by John Boyd and Michael Lacy and is related to presently pending U.S. application Ser. No. 10/255,403 filed on the same date as the instant application, which is a continuation of U.S. application Ser. No. 09/609,590. The entire disclosure of each of these applications is incorporated herein by reference.

FIELD OF THE INVENTION

The present invention relates to the field of fixed abrasive substrates. More particularly, the invention relates to a method and apparatus for fixed abrasive preparation and use in a cluster chemical-mechanical polishing (CMP) tool.

BACKGROUND

One of the last stages before fabrication of semiconductor devices on a semiconductor substrate, such as Si or III–V related compounds (e.g. GaAs, InP), involves the polishing of the semiconductor wafer. One reason wafer polishing is performed is to remove any irregularities present on the surface so that the wafer is smooth and flat prior to performing any initial fabrication steps (such as etch, metalization or photolithography). In addition, CMP is also used to planarize the semiconductor wafer subsequent to initiation of device fabrication, for example after deposition of polyamide or other insulating material on the wafer.

In general, prior to device fabrication, there are two types of polishing: rough polishing and chemical-mechanical polishing (CMP) in which the rough polishing precedes the CMP. Rough polishing is a conventional abrasive process whose primary purpose is to remove the surface damage leftover from the wafer-slicing process of diamond saws that created the wafer. CMP follows the rough polishing and is typically a combination of chemical etching and mechanical buffing. During device fabrication, only CMP is used as rough polishing is too abrasive to afford the necessary planarization control.

In a conventional CMP rotary or orbital system, wafers are mounted upside-down on rotating circular holders and lowered onto a polishing pad rotated in the opposite direction. The polishing pad is generally polyurethane or urethane-coated with felt and sits on a pallet. For ridding the surface of irregularities prior to fabrication, a slurry containing silica suspended in a mild etchant such as potassium or ammonium hydroxide is added to the polishing pad. A thin layer of silicon dioxide chemically grows on the surface of the wafer as a result of contact with the alkaline slurry. This layer is continuously removed mechanically by the buffing action of the polishing pad. The process generally reduces the irregularities of the wafer to a small percentage of the wafer diameter over the entire surface of the wafer. For planarization during processing, e.g. planarizing to flatten the wafer profile in multi-metal interconnection schemes, the CMP apparatus must remove oxides and various metals in addition to any planarizing material and/or wafer material.

To achieve the necessary precision without polishing away the active circuitry, a number of variables in any CMP apparatus can be controlled. For example, the numerous diverse variables that can be controlled include: composition of the slurry, rate of feed or introduction of the slurry to the pad, pad characteristics (both the pad material and the condition of the pad), polishing time, rotational speed of both the pad and wafer, and pressure of the wafer on the pad. The slurry characteristics to be controlled include the particulate size and pH of the etchant solution. In addition, slurries are chosen to balance chemical removal with abrasiveness so that the production rate of wafers through the CMP apparatus is acceptable (as is the planarity of the resultant wafer).

More recently, some current CMP systems/modules have eschewed conventional slurries as described above, turning to fixed abrasive polishing instead. To date, a number of forms of fixed abrasives exist. Materials are produced either as a roll or as a fixed pad. The roll is slowly and continuously fed into a CMP module, while the fixed pad is applied to the conventional rotary or orbital system. At least one of the problems with these current fixed-abrasive CMP systems is similar to that of more-conventional slurry-type systems; a high cost of ownership of the system for the user. Additional problems include both inconsistent results of the fixed abrasive as the abrasive wears away due to usage and reliance on third-party produced consumable abrasive or slurry material.

BRIEF SUMMARY

To solve these problems, an arrangement containing a modified fixed abrasive material and method of using the same has been developed using a pre-patterned substrate onto which the fixed abrasive is disposed.

A first aspect of the present invention is directed towards a method of fixed abrasive substitute preparation and use. The method entails providing a substrate having a predetermined three-dimensional pattern and introducing a coating of an abrasive, an abrasive and binder, or abrasive/binder mixture to the surface of the substrate. The coating coats the pattern on the surface of the substrate. A semiconductor wafer is planarized to a desired uniformity by the interaction of coated substrate and the semiconductor wafer.

In one embodiment, the method may include patterning the substrate prior to introducing the coating to the surface of the substrate. Introducing the coating to the surface of the substrate may include vacuum depositing the abrasive/binder mixture on the surface of the substrate. Similarly, the method may include a curing process enabling curing of the binder such that the abrasive better adheres to the surface of the semiconductor.

In other embodiments, the method may include stripping the substrate of remaining abrasive subsequent to planarizing semiconductors wafers. The stripping of the coating occurs in cleaning chamber and the substrate is subsequently transferred to a deposition chamber in which the substrate is re-coated with the coating to which new semiconductor wafers requiring planarization may be applied.

A second aspect is directed towards an apparatus for preparation and use of a polishing substrate. The apparatus comprises a substrate having a predetermined three-dimensional pattern, a coating layer is coated on a surface of the substrate, a vacuum deposition chamber that is configured to receive the substrate and in which the coating layer is applied to the surface of the substrate and a chemical-mechanical polishing chamber is disposed downstream from the vacuum deposition chamber and configured to receive both the coated substrate and a semiconductor wafer. The chemical-mechanical polishing chamber is configured to planarize the semiconductor wafer.

A third aspect is directed to an apparatus that comprises the vacuum deposition chamber and chemical-mechanical polishing chamber above. The substrate in this aspect has a predetermined three-dimensional pattern and a coating layer that contains particles of 0.1 $\mu$m to 3.0 $\mu$m is disposed on a surface of the substrate.

In the aspects, the coating layer may comprise an abrasive layer, a binder layer may be disposed between the abrasive layer and the surface of the substrate and a cure mechanism may apply a curing process to the coated substrate prior to planarization of the semiconductor wafer such that the abrasive is bound to the substrate.

Similarly, in the aspects the coating layer may comprise a non-abrasive material layer that is suitable for use with an abrasive slurry, a binder layer may be disposed between the non-abrasive material layer and the surface of the substrate, and a cure mechanism may apply a curing process to the coated substrate prior to planarization of the semiconductor wafer such that the non-abrasive material is bound to the substrate.

Alternatively, in the aspects the coating layer may comprise an abrasive/binder mixture that is suitable for use with an abrasive slurry and a cure mechanism may apply a curing process to the coated substrate prior to planarization of the semiconductor wafer such that the abrasive/binder mixture layer is bound to the substrate.

The aspects may further comprise a cleaning chamber that removes at least a remainder of the coating layer from the substrate subsequent to application of the coated substrate to the semiconductor wafer via plasma-assisted gas etching, the cleaning chamber disposed downstream of the chemo-mechanical polishing chamber and a substrate transfer mechanism that transfers the substrate from the cleaning chamber to the vacuum deposition chamber. In this case, subsequent to the removal of the remainder of the coating layer from the substrate in the cleaning chamber, the substrate is transferred to the vacuum deposition chamber by the substrate transfer mechanism and a new coating layer is applied to the substrate.

The pattern may be selected from a group consisting of a rectangular pattern, a trapezoidal pattern, a hemispherical pattern, a pillar pattern and a prismatic pattern. The pattern may have a maximum height of about 20 $\mu$m to about 50 $\mu$m and a maximum width of about 100 $\mu$m to about 1000 $\mu$m. The pattern may have a density of 60–95%. An area of the coating layer that is exposed as a fixed consumable may remain constant with planarization usage.

It is therefore an advantage of the present invention to increase the reliability and decrease the cost of a CMP system by providing an arrangement and method to better control the amount of abrasive material used during planarization of a semiconductor wafer. An additional advantage of the present invention is the improvement in process control of the planarization of the semiconductor wafer.

The following figures and detailed description of the preferred embodiments will more clearly demonstrate these and other objects and advantages of the invention.

DETAILED DESCRIPTION OF THE PRESENTLY PREFERRED EMBODIMENTS

Figure 1:
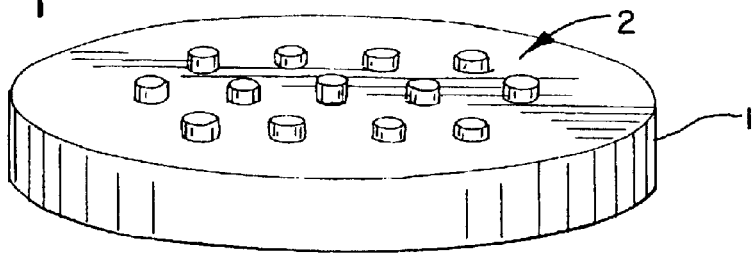
FIG. 1 illustrates a top view of a first embodiment of a patterned substrate of the present invention.
Figure 2:
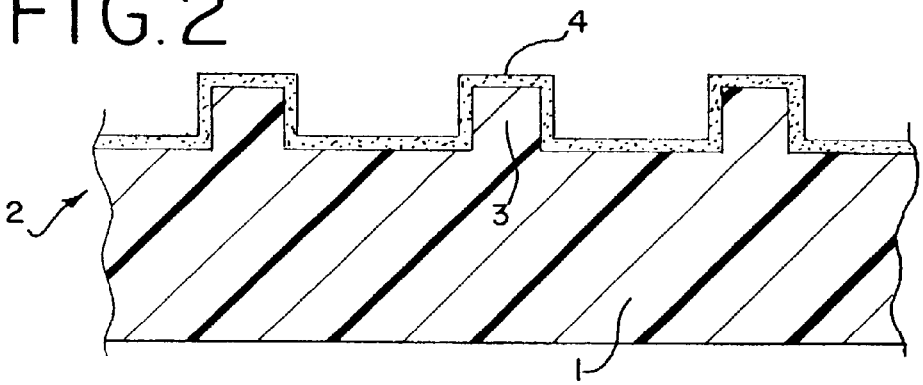
FIG. 2 shows a side view of a first embodiment of a patterned substrate of the present invention.

FIGS. 1 and 2 depict top and side views of a preferred embodiment of a fixed abrasive substrate according to the present invention. In FIG. 1, a substrate 1 is provided with an abrasive-coated predetermined pattern 2. FIG. 2 depicts a side view of the coated substrate 1 better showing the abrasive-coated predetermined pattern 2, which consists of a predetermined pattern 3 and a fixed abrasive 4 coating the pattern 3. As shown, the layer containing the fixed abrasive 4 is the outermost layer containing an abrasive.

The substrate 1 is made of a durable material that is suitable for use in a standard vacuum deposition process. Examples of typical materials include, but are not limited to, ceramic, rigid plastic or other rigid material such as polyethylene terephthalate (PET). The substrate is generally purchased from a vendor of the particular material that comprises the substrate.

The substrate pattern is a three-dimensional topographical pattern that may be prepared by a number of different methods, including physically or chemically etching the substrate to form the pattern or depositing the pattern on the substrate via a deposition process. In the latter case, i.e. deposition, the pattern may be formed of either the same material as the substrate or a different material that is maintained on the substrate through repeated deposition of abrasive on the substrate and cleaning of the substrate by removal of the abrasive remaining on the substrate after numerous planarizations. In addition, the pattern on a substrate may be altered as desired by re-patterning the substrate. This may be accomplished by stripping (or partially stripping) the substrate of the prior pattern, cleaning the substrate and re-etching or re-depositing pattern material on the substrate. Although either chemical means (e.g. chemical etching) or mechanical means (e.g. grinding, mechanical etching) may be used to strip a prior pattern from the substrate, chemical means are generally used to clean the substrate, either when removing the abrasive or after stripping the prior pattern.

Figure 3A:
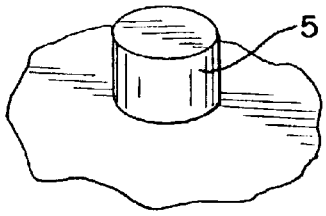
FIGS. 3A and 3B show second and third embodiments of patterned substrates of the present invention.
Figure 3B:
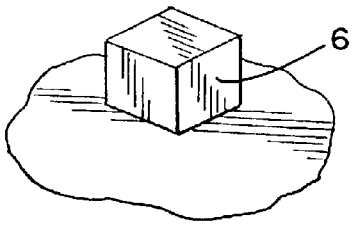

The substrate pattern 3 is selected such that die-level and/or wafer-level planarization is optimized when the abrasive-coated substrate pattern 2 is applied to a desired semiconductor wafer to be planarized. The shape of the substrate pattern 3 is particularly important for maintaining stability in the chemical-mechanical polishing process. A general objective is to select a pattern that will enable chemical transport of slurry or other fluid-based chemistry to the wafer/substrate interface and reaction by-product away from the substrate. One advantage of using a predetermined pattern is that the density of the pattern (both the number of shapes/unit area on the substrate and the amount of pattern/unit area on the substrate) is preset, thus allowing the user to select a pattern to best suit the processing needs for a particular wafer by increasing control over the planarization process. One suitable range of pattern density is from 60% to 95%. In addition to pattern density, the specific pattern profile, i.e. shape, may be selected. For example, in some cases the surface area of the fixed abrasive that contacts the surface of the semiconductor wafer during polishing may be desired to be constant for predictability and reliability reasons. One preferred shape having a constant cross-section is a pillar-like shape. Examples of typical pillar-like patterns with constant surface area with wear are shown in FIGS. 3A and 3B. FIG. 3A illustrates a circular-type pillar 5 while FIG. 3B depicts a square-based pillar 6. Alternate pillar shaped patterns having a surface area that remains constant with usage, such as ovular-type or rectangular-based pillars (not shown), may be constructed in addition to those depicted in FIGS. 3A and 3B.

Figure 4A:
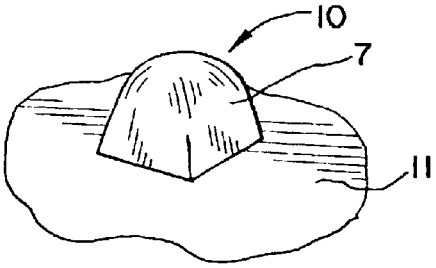
FIGS. 4A and 4B depict fourth and fifth embodiments of patterned substrates of the present invention.
Figure 4B:
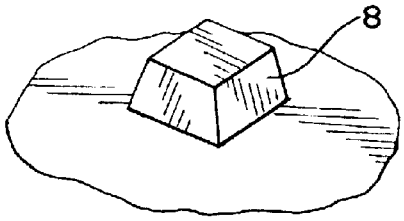

Other patterns may also be used in which the surface area does not remain constant with usage as shown in FIGS. 4A and 4B. FIG. 4A depicts a side view of a substrate 1 having hemispherical patterns 7, while FIG. 4B shows a side view of a substrate 1 having trapezoidal patterns 8. Once a substrate having these or similar patterns is coated with the abrasive, and is then used to polish a semiconductor wafer, the coated abrasive wears away while polishing the wafer to expose an increasing amount of abrasive (i.e. the surface area of the abrasive increases). This is because, as in the above patterns with constant cross-sectional area, the abrasive covers the surface of the individual pattern, e.g. a hemisphere. In this case, as opposed to a pillar-like pattern, the cross-sectional area of the uncoated hemisphere itself increases from the top of the air/pattern interface 10 to the pattern/substrate interface (the base) 11. Thus, the increase in surface area of the abrasive due to erosion with usage parallels a similar increase in cross-sectional area of the hemisphere. In this case, the surface area is $4\pi(r_0-h)^2$, where $r_0$ is the radius of the hemisphere and h is the distance from the base of the hemisphere 11 to the top of the air/interface 10, as shown in FIG. 5.

Figure 6:
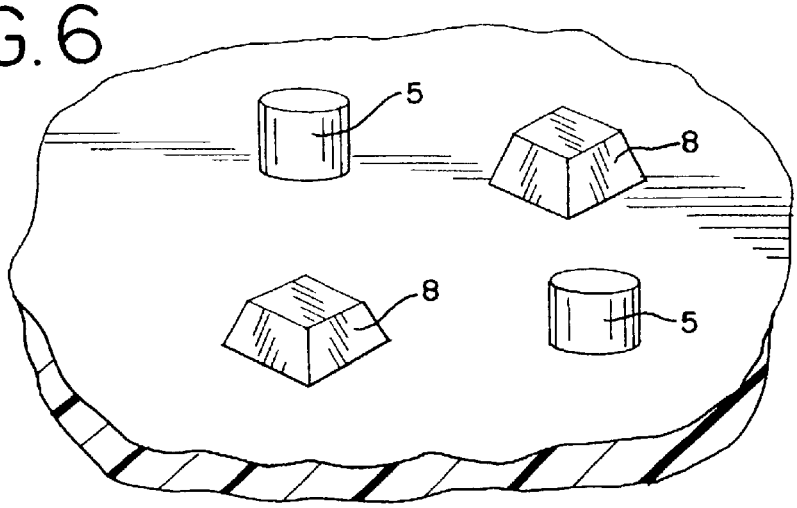
FIG. 6 shows a sixth embodiment of a patterned substrate of the present invention.

Patterns having increasing surface area during usage may be used where a high degree of surfacing with a smaller abrasive contact area is initially desired and subsequently the benefit of a larger abrasive contact area is desired during polishing/planarization of the semiconductor wafer. Alternatively, a combination of patterns with constant and increasing surface area may be used, as illustrated in FIG. 6. In this embodiment, the substrate having a combination of patterns may be used where one type of pattern enables another type of pattern to achieve a desired result or enhances the result obtained by another type of pattern. For example, assuming only two types of patterns, pattern A and pattern B, exist on the substrate, pattern A may enable activation of the material surface, say via chemistry of an alkali slurry, while patter B may remove the activated material. In this embodiment, pattern A preferably has a smaller surface area (locally) than pattern B. Patter A would then provide a higher pressure to the wafer surface than pattern B and allow chemical action to occur on the wafer, and the lower pressure imparted by pattern B would act to remove activated material.

Figure 5:
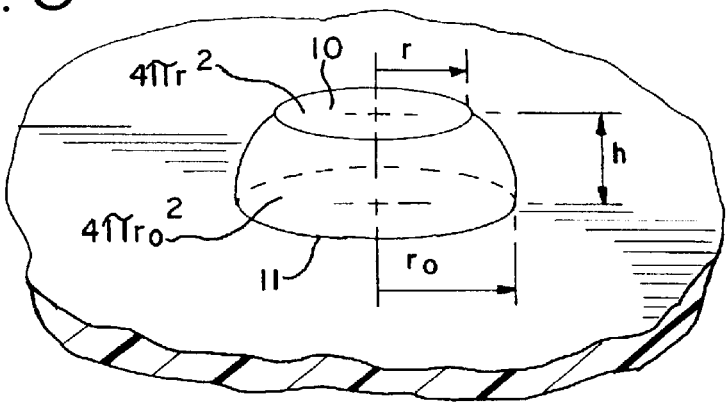
FIG. 5 illustrates the change in surface area of the patterned substrate according to the fifth embodiment of the present invention.

Although specific dimensions may vary, in any of the above patterns, either those having constant or increasing cross-sectional area, typical features of a particular shape might be a maximum height (as measured from the base and shown in FIG. 5 as h) of 20–50 $\mu$m and a maximum width of 100–1000 $\mu$m (i.e. $2\times r_0$ in FIG. 5). As shown in FIG. 5, the base of all of the patterns in such a combination of patterns is disposed along substantially the same plane, discounting surface roughness which causes minor variations in substrate thickness. The surface roughness is not shown in any of the figures. This is to say that the laterally separated patterns essentially begin at the same level, the surface of the substrate, rather than being etched into the substrate. Thus, if channels or pits are etched into the substrate, the top of the channel or pit essentially defines the surface of the substrate rather than the bottom of the channel or pit.

Figure 7A:
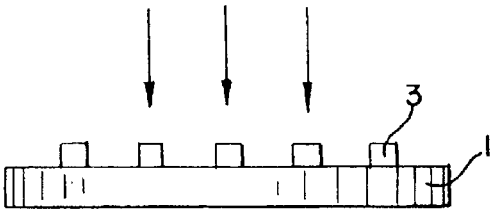
FIGS. 7A and 7B show side views of the first embodiment of the present invention before and after deposition of the fixed abrasive.
Figure 7B:
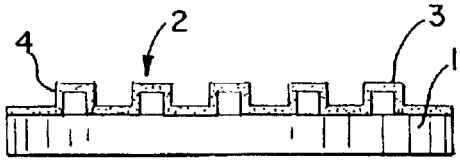

The process by which the substrate having a predetermined pattern is coated and used will be described with respect to FIGS. 7–10. Initially, one surface of the substrate is patterned with the desired pattern characteristics, including shape and density as mentioned above, using standard methods. The substrate may be in the form of a rotary disk, linear belt or other desired shape. After preparation of the substrate, the pre-patterned substrate is loaded into a standard deposition (vacuum) chamber 50. The deposition chamber 50 is evacuated to a pressure $\leqq 1$ $\mu$Torr and then backfilled to a desired deposition pressure with an appropriate deposition gas. A fixed abrasive/binder mixture is then vacuum deposited on the substrate, as shown in FIGS. 7A and 7B. FIG. 7A shows the substrate prior to deposition of the mixture and FIG. 7B depicts the combination of the substrate and mixture subsequent to deposition.

The abrasive of the fixed abrasive/binder mixture may be formed of silica and/or other materials such as ceria, manganese oxide or similar earth-metal oxide material of appropriate hardness. In one embodiment, the particles that comprise the abrasive may range in size from 0.1 $\mu$m to 3.0 $\mu$m. The binder allows the abrasive to adhere to the substrate. The binder may be made from any of several conventional binding mixtures such as organic polymers. Of course, alternate processes may be used as well, such as individual deposition of the binder material and the abrasive material or deposition of the abrasive material without the binder material. If the abrasive material is deposited without a separate binder material, the abrasive may adhere with enough strength to allow planarization of a semiconductor wafer or a curing process performed by a cure mechanism (described below) may be applied to the substrate prior to planarization of the semiconductor wafer.

Following the deposition, the substrate and fixed abrasive/binder mixture combination may be annealed or subjected to a curing process if necessary. The curing process sets the binder to more firmly adhere the abrasive to the substrate and may be performed either in-situ with the deposition process or ex-situ, in a separate cure mechanism. This is to say that, if the curing process is performed in situ, the substrate remains in the deposition chamber 50 at atmospheric pressure or less and annealing is performed by the cure mechanism in a range of temperatures between room temperature (approximately 20° C.) and the material melting point (typically >150° C.), depending on the particular binder used. The curing process can also be performed ex-situ, in which case the substrate and fixed abrasive/binder mixture combination is removed from the deposition chamber 50 and annealed in an ambient atmosphere and temperature depending on the particular binder used. In this case, the substrate may be annealed in a separate cure mechanism, such as a conventional annealing apparatus.

Subsequent to the deposition and/or curing process, the substrate is transferred to a CMP system, such as the TERES polishing system available from Lam Research Corp., Fremont, Calif. As described previously, the substrate may either be prepared as a roll or a fixed pad. Thus, the substrate having the fixed abrasive may be in a fixed pad/wafer-type form or a continuous roll, and is used to polish and/or planarize semiconductor wafers introduced to the CMP system. The fixed pad-type substrate is applied to a rotary or orbital CMP system 100, as shown in FIG. 8, while the prepared substrate/roll is slowly and continuously fed into the CMP system 200 as shown in FIG. 9.

Figure 8:
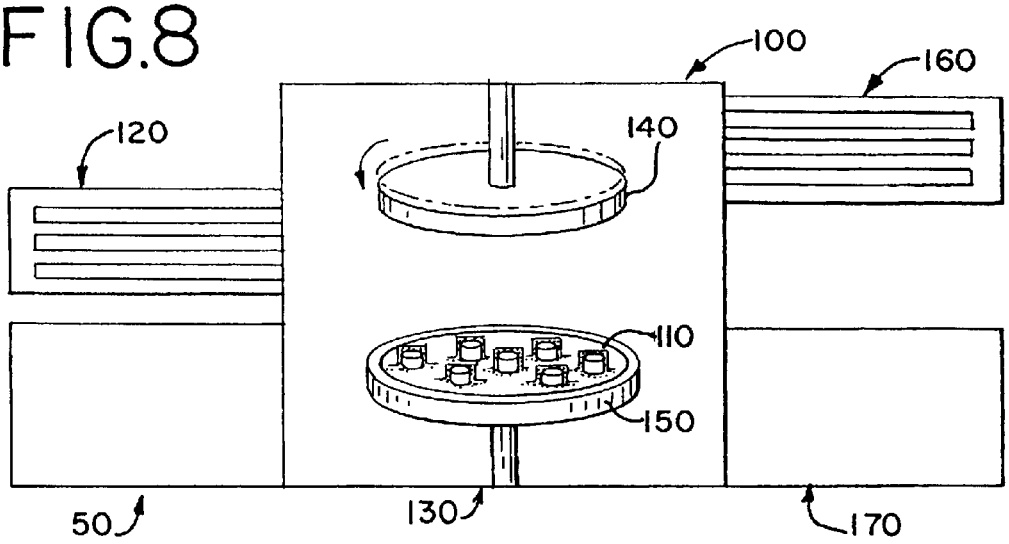
FIG. 8 shows a rotary-type CMP system of the present invention.
Figure 9:
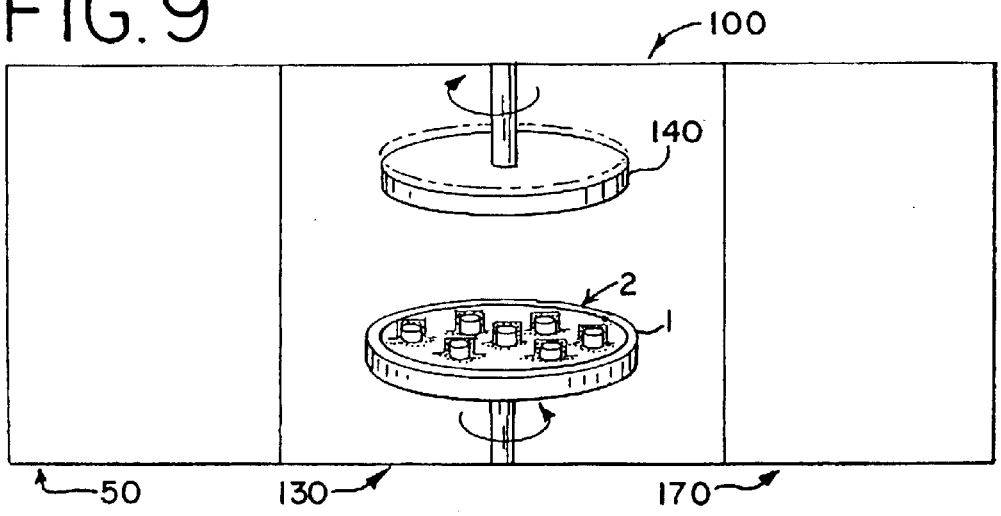
FIG. 9 shows a continuous feed-type CMP system of the present invention.

FIG. 8 illustrates a stand-alone CMP system 100 in which either a single substrate 110 is prepared and loaded into the CMP system 100 or a plurality of single substrates are prepared and loaded into a magazine-style feeder 120. The loaded feeder 120 is then installed into the CMP system 100 for automated loading and unloading of an individual substrate 110 contained in the loaded feeder 120. The automated loading system of the CMP system 100 loads an individual substrate 110 contained in the loaded feeder 120 into an application chamber 130. A semiconductor wafer 140 to be planarized is introduced into the application chamber 130 either before or after the substrate 110 is loaded. The substrate 110 is rotated at a predetermined spin speed while the wafer 140 is rotated in the opposite direction at a spin speed to achieve a desired relative surface velocity. Typical relative surface velocities are 125 to 400 feet per minute, however even higher relative surface velocities may be used. In addition, although as depicted the substrate 110 is held from the top and the wafer 140 is retained from the bottom of the CMP system 100, the relative positions of the substrate 110 and wafer 140 may be reversed. The wafer 140 is usually retained on a chuck 150 by vacuum clamping.

After the abrasive coating on the loaded substrate 110 has eroded by wear to a preset amount, the substrate 110 is unloaded and may be placed in a reclaim magazine 160. The reclaim magazine 160 is filled with at least one eroded substrate and subsequently transferred from the application chamber 130 to a cleaning chamber 170. Although depicted in-situ in FIG. 8, the cleaning chamber 170 may be a separate module from the CMP system 100. Commercially available cleaning chambers, such as wet cleaning chambers utilizing sulfuric-peroxide wet cleaning chemistry available from FSI International, Inc. of Chaska, Minn., cleaning chambers from Semitool, Inc. of Kalispell, Mont., or a standard plasma-assisted gas etch utilizing $O_2$ plasma followed by a brush scrub clean in an OnTrak scrubber available from Lam Research Corporation of Fremont, Calif., may be used to clean the substrate via chemical means described below.

Figure 10:
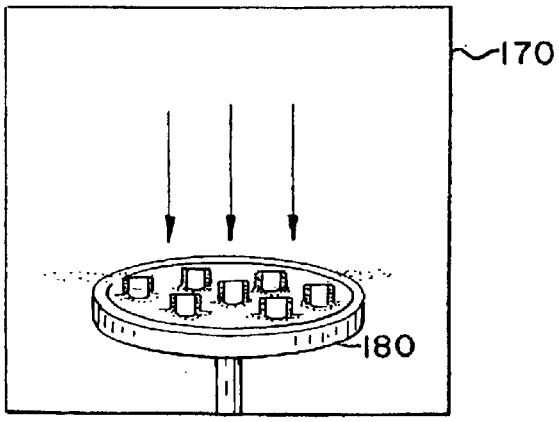
FIG. 10 shows a used substrate disposed in a cleaning chamber of the present invention.

As depicted in FIG. 10, when the eroded substrate 180 is disposed in the cleaning chamber 170, which is downstream of the chemo-mechanical polishing chamber, the remaining abrasive is removed from the eroded substrate 180 thereby cleaning the substrate. One approach may be to introduce a gas chemistry to etch away the remaining abrasive. These types of processes are usually assisted by plasma energy. A typical etch process may include evacuation of the etch chamber to $\leqq 1\ \mu$Torr, backfilling with an etch chemistry and applying power to generate a plasma.

After the etch process is complete, the chamber is vented back to atmosphere and the substrate is removed. This is to say that, subsequent to cleaning, the stripped substrate (indicated by dashes) containing the original predetermined pattern is then transferred to the deposition chamber 50 by a substrate transfer mechanism such as a robot/robotic arm. Note that the substrate, during transfer, may be contained in the reclaim magazine 160, which has a number of cartridges to hold individual substrates. A fresh abrasive/binder mixture is applied to coat the previously denuded substrate. The process for coating the substrate with the abrasive/binder mixture is the same as that described above. As mentioned before, the deposition chamber 50, application chamber 130 and cleaning chamber 170 may be individual modules, or may be integral parts of the entire CMP system 100.

The use of the present invention has advantages, one of which is a lower cost of ownership for the owner of the CMP system as purchase of external manufactured consumables (pads, etc. . . . ) from third party sources are reduced/replaced by purchase of (lower cost) raw materials. In addition, this invention allows control of the abrasiveness of the pad by allowing pattern characteristics such as pattern density, shape and size to be predetermined and/or modified. Further, the present invention permits the user to set the desired abrasive characteristics such as abrasiveness and thickness of the coating as desired, thus allowing an even finer control of planarization.

Alternately, rather than applying fixed abrasive to the surface of the patterned substrate, other materials may be applied. For example, a non-abrasive pad-type material may be introduced to the surface of the substrate. The pad-type material may be polyurethane or other suitable compound, similar to the material of conventional pads used in standard planarization processes. The method of introducing the material to the pre-patterned substrate would be similar to that above, e.g. depositing and adhering (if necessary) the pad-type material on the surface of the substrate, applying the coated substrate to at least one semiconductor wafer requiring planarization, stripping the pad-type material after the pad-type material is sufficiently eroded (i.e. cleaning the substrate), replacing the pad-type material, and reusing the pad-type material. As above, the particular material used determines the specifics of the process, e.g. atmospheres, timing, and temperatures during processing. In this case, however, as the abrasives are not fixed, conventional slurries may be used during planarization of semiconductor wafers, having replaced the conventional pad with the pre-patterned substrate coated with the pad-type material of the present invention. Substrates prepared with standard pad coatings would then be usable with abrasive slurries commonly available in the CMP industry.

While the invention has been described with reference to specific embodiments, the description is illustrative of the invention and not to be construed as limiting the invention. Various modifications and applications may occur to those skilled in the art without departing from the true spirit and scope of the invention as defined in the appended claims.

What is claimed is:

1. An apparatus for preparation and use of a polishing substrate comprising:

a substrate having a predetermined three-dimensional pattern formed on a surface thereof, with individual patterns of the three-dimensional pattern having a maximum height of about 20 $\mu$m to about 50 $\mu$m and a maximum width of about 100 $\mu$m to about 1000 $\mu$m;

a coating layer coated on substantially the entirely of the surface of the substrate;

a vacuum deposition chamber, configured to receive the substrate and in which the coating layer is applied to the surface of the substrate; and a chemical-mechanical polishing chamber disposed downstream from the vacuum deposition chamber and configured to receive both the coated substrate and a semiconductor wafer, the chemical-mechanical polishing chamber configured to planarize the semiconductor wafer.

2. The apparatus of claim 1, further comprising:

a cleaning chamber that removes at least a remainder of the coating layer from the substrate subsequent to application of the coated substrate to the semiconductor wafer via plasma-assisted gas etching, the cleaning chamber disposed downstream of the chemo-mechanical polishing chamber; and a substrate transfer mechanism that transfers the substrate from the cleaning chamber to the vacuum deposition chamber;

wherein subsequent to removal of the remainder of the coating layer from the substrate in the cleaning chamber, the substrate is transferred to the vacuum deposition chamber by the substrate transfer mechanism and a new coating layer is applied to the substrate.

3. The apparatus of claim 1, wherein the pattern is selected from the group consisting of a rectangular pattern, a trapezoidal pattern, a hemispherical pattern, a pillar pattern and a prismatic pattern.

4. The apparatus of claim 1, wherein the pattern has a density of 60–95%.

5. The apparatus of claim 1, wherein an area of the coating layer exposed as a fixed consumable remains constant with planarization usage.

6. The apparatus of claim 1, wherein the pattern is in contact with the surface.

7. The apparatus of claim 1, wherein the coating layer is an outermost layer that contains any abrasive.

8. The apparatus of claim 1, wherein the coating layer comprises an abrasive layer.

9. The apparatus of claim 8, further comprising a binder layer disposed between the abrasive layer and the surface of the substrate.

10. The apparatus of claim 9, further comprising a cure mechanism that applies a curing process to the coated substrate prior to planarization of the semiconductor wafer such that the abrasive is bound to the substrate.

11. The apparatus of claim 1, wherein the coating layer comprises a non-abrasive material layer that is suitable for use with an abrasive slurry.

12. The apparatus of claim 11, further comprising a binder layer disposed between the non-abrasive material layer and the surface of the substrate.

13. The apparatus of claim 12, further comprising a cure mechanism that applies a curing process to the coated substrate prior to planarization of the semiconductor wafer such that the non-abrasive material is bound to the substrate.

14. The apparatus of claim 1, wherein the coating layer comprises an abrasive/binder mixture.

15. The apparatus of claim 14, further comprising a cure mechanism that applies a curing process to the coated substrate prior to planarization of the semiconductor wafer such that the abrasive/binder mixture layer is bound to the substrate.

16. An apparatus for preparation and use of a polishing substrate comprising:

a substrate having a predetermined three-dimensional pattern;

a coating layer disposed on a surface of the patterned substrate, the coating layer containing particles of 0.1 $\mu$m to 3.0 $\mu$m, the coating layer and particles formed in a single layer;

a vacuum deposition chamber, configured to receive the substrate and in which the coating layer is applied to the surface of the substrate; and a chemical-mechanical polishing chamber disposed downstream from the vacuum deposition chamber and configured to receive both the coated substrate and a semiconductor wafer, the chemical-mechanical polishing chamber configured to planarize the semiconductor wafer.

17. The apparatus of claim 16, further comprising:

a cleaning chamber that removes at least a remainder of the coating layer from the substrate subsequent to application of the coated substrate to the semiconductor wafer via plasma-assisted gas etching, the cleaning chamber disposed downstream of the chemo-mechanical polishing chamber; and a substrate transfer mechanism that transfers the substrate from the cleaning chamber to the vacuum deposition chamber;

wherein subsequent to the removal of the remainder of the coating layer from the substrate in the cleaning chamber, the substrate is transferred to the vacuum deposition chamber by the substrate transfer mechanism and a new coating layer is applied to the substrate.

18. The apparatus of claim 16, wherein the pattern is selected from the group consisting of a rectangular pattern, a trapezoidal pattern, a hemispherical pattern, a pillar pattern and a prismatic pattern.

19. The apparatus of claim 16, wherein the pattern has a maximum height of about 20 $\mu$m to about 50 $\mu$m and a maximum width of about 100 $\mu$m to about 1000 $\mu$m.

20. The apparatus of claim 16, wherein the pattern has a density of 60–95%.

21. The apparatus of claim 16, wherein an area of the coating layer exposed as a fixed consumable remains constant with planarization usage.

22. The apparatus of claim 16, wherein the pattern is in contact with the surface.

23. The apparatus of claim 16, wherein the coating layer is an outermost layer that contains abrasive particles.

24. The apparatus of claim 16, wherein the coating layer comprises an abrasive layer.

25. The apparatus of claim 24, further comprising a binder layer disposed between the coating layer and the surface of the substrate.

26. The apparatus of claim 25, further comprising a cure mechanism that applies a curing process to the coated substrate prior to planarization of the semiconductor wafer such that the coating layer is bound to the substrate.

27. The apparatus of claim 16, wherein the coating layer comprises a non-abrasive material layer that is suitable for use with an abrasive slurry.

28. The apparatus of claim 27, further comprising a binder layer disposed between the non-abrasive material layer and the surface of the substrate.

29. The apparatus of claim 28, further comprising a cure mechanism that applies a curing process to the coated substrate prior to planarization of the semiconductor wafer such that the non-abrasive material is bound to the substrate.

30. The apparatus of claim 16, wherein the coating layer comprises an abrasive/binder mixture.

31. The apparatus of claim 30, further comprising a cure mechanism that applies a curing process to the coated substrate prior to planarization of the semiconductor wafer such that the abrasive/binder mixture layer is bound to the substrate.

* * * * *